US007449625B2

(12) United States Patent
Johnson et al.

(10) Patent No.: US 7,449,625 B2
(45) Date of Patent: Nov. 11, 2008

(54) RESTRAINT FOR ENDPIN OF A CELLO OR OTHER FLOOR-RESTING STRINGED MUSICAL INSTRUMENTS

(75) Inventors: Matthew Johnson, 104 Circle Dr., York, PA (US) 17402; Brenda Johnson, 104 Circle Dr., York, PA (US) 17402

(73) Assignees: Matthew Johnson, York, PA (US); Brenda Johnson, York, PA (US)

( * ) Notice: Subject to any disclaimer, the term of this patent is extended or adjusted under 35 U.S.C. 154(b) by 352 days.

(21) Appl. No.: 11/285,796

(22) Filed: Nov. 23, 2005

(65) Prior Publication Data

US 2006/0174747 A1 Aug. 10, 2006

Related U.S. Application Data

(60) Provisional application No. 60/649,957, filed on Feb. 4, 2005.

(51) Int. Cl.
*G10D 3/12* (2006.01)

(52) U.S. Cl. ..... 84/302; 482/121

(58) Field of Classification Search ..... 84/302, 84/280, 281, 327, 421, 453; 482/121
See application file for complete search history.

(56) References Cited

U.S. PATENT DOCUMENTS

| | | | | | |
|---|---|---|---|---|---|
| 915,345 | A * | 3/1909 | Gould | 84/280 |
| 1,288,179 | A | 12/1918 | Poehland | |
| 2,974,556 | A | 3/1961 | Fawick | 84/280 |
| 4,018,129 | A | 4/1977 | Hollander | 84/280 |
| 5,003,858 | A * | 4/1991 | Rowell | 84/280 |
| 5,696,338 | A | 12/1997 | Grissom | 84/327 |
| 5,921,900 | A * | 7/1999 | Mankovitz | 482/121 |
| 6,696,626 | B1 * | 2/2004 | Pagenkopf | 84/280 |

* cited by examiner

*Primary Examiner*—Walter Benson
*Assistant Examiner*—Jianchun Qin
(74) *Attorney, Agent, or Firm*—Duane Morris LLP

(57) ABSTRACT

A device for restraining or anchoring the endpin of a floor-resting musical instrument such as a cello or a string bass is provided for allowing the musician to hold the musical instrument in a desired position and prevent the endpin from sliding around on the floor surface. The device also protects the surface of the floor from being damaged by a sliding endpin. The device also does not dampen the sound of the musical instrument.

12 Claims, 18 Drawing Sheets

(Position 1)

(Position 2)

(Position 2)

(Position 1)

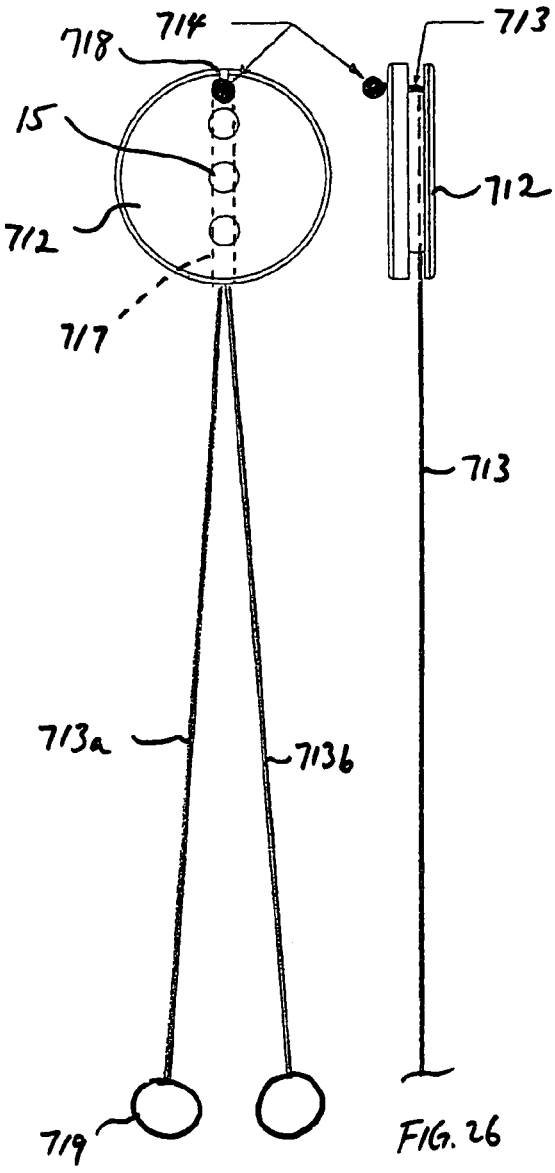
FIG. 25
FIG. 26
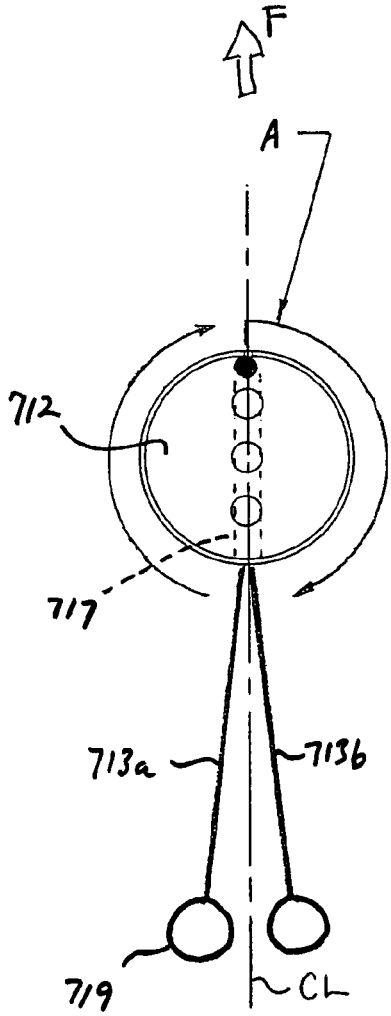
FIG. 27
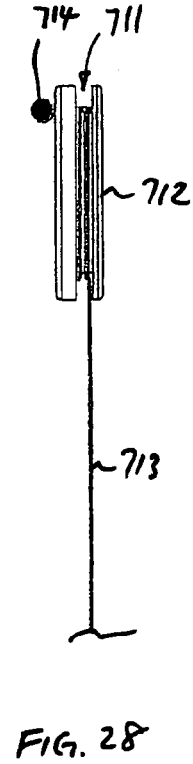
FIG. 28

RESTRAINT FOR ENDPIN OF A CELLO OR OTHER FLOOR-RESTING STRINGED MUSICAL INSTRUMENTS

CROSS REFERENCE TO RELATED APPLICATIONS

This application claims the benefit of the U.S. Provisional Application No. 60/649,957 filed on Feb. 4, 2005, the contents of which are expressly incorporated herein by reference.

FIELD OF THE INVENTION

The present invention relates generally to a stabilizing device used in conjunction with the endpin of a floor-resting musical instrument such as a cello or a string bass.

BACKGROUND OF THE INVENTION

Musical instruments such as a cello or a string bass are provided with an endpin at its bottom for resting the instrument on the floor as the musician, who is usually sitting on a chair, holds the instrument in a suitable position. Because the free end of the endpin directly contacts the floor, if the endpin slides along the floor surface, the musician's performance is impaired and additionally may damage the surface of the floor.

Many devices are known that will prevent the endpin from sliding on the floor and they generally fall into two types. First type of devices are frictional devices generally made of rubber or rubber-like polymer that may be attached to the tip of the endpin or attached to the floor. An example of such device is described in U.S. Pat. No. 5,696,338 to Grissom. These type of devices have a number of disadvantages, such as, reduced resonance of the musical instrument caused by the dampening qualities of the devices. Also, the coefficient of friction of these devices tend to diminish in relatively short period of time and renders them ineffective.

Another type of known devices are mechanical types that mechanically attach the endpin of the musical instrument to a fixed object such as the legs of the musician's chair. Examples of such devices are described in U.S. Pat. No. 6,696,626 to Pagenkopf, U.S. Pat. No. 5,003,858 to Rowell, U.S. Pat. No. 3,598,011 to Henkle, and U.S. Pat. No. 1,288,179 to Poehland. These known devices also have their own deficiencies. For example, some of the known devices require adjustment with every use. Some known devices require two hands to adjust the anchoring position of the musical instrument. Some known devices require the musician to stand and remove the device from under the chair or reposition a portion of the device that is attached to the chair in order to adjust the anchoring position of the musical instrument. Some known devices only restrain the endpin in only one direction and allow the endpin to move side-to-side. Some known devices use one attachment point on the fixed object (i.e. one chair leg), therefore, if the forces applied through the endpin are not coincident with the longitudinal axis of the tension member or the device itself, the device will rotate about the single attachment point or fixed object until the tension member aligns with the force applied through the endpin. Some known devices are bulky and cumbersome to transport.

Therefore, there is a need for improved device for restraining or anchoring the endpin of a musical instrument such as a cello or a string bass.

SUMMARY OF THE INVENTION

According to an aspect of the present invention, an endpin restraint for a floor-resting musical instrument such as a cello or a string bass is provided for allowing the musician to hold the position of the musical instrument in a desired position and prevent the endpin from sliding around on the floor surface. The endpin restraint generally comprises a generally rigid endpin holder, for positioning at a distance from a chair upon which a musician is seated to play the musical instrument. The endpin holder has an upper surface provided with a plurality of endpin receiving structures. These endpin receiving structures may be pocket-like structures which are concave and they may also be bossed structures that protrude from the upper surface of the endpin holder. The endpin restraint also includes a flexible tension member, which may be a chord made of any variety of appropriate material, having a proximal end and a distal end, for connecting the endpin holder to the legs of the chair. Preferably, the tension member is not elastic. The distance between the endpin holder and the musician's chair is adjusted by threading or wrapping varying lengths of the flexible tension member at its distal end within the endpin holder and thereby adjusting the length of the flexible tension member.

The particular shape of the endpin holder and the particular configuration for threading or wrapping the flexible tension member within the endpin holder may vary according to the present invention. These various embodiments are described further in the Detailed Description below in combination with the drawings representing the exemplary embodiments.

BRIEF DESCRIPTION OF THE DRAWINGS

FIGS. 22-29 are illustrations of another embodiment of the endpin restraint whose endpin holder has a disk-like shape.

The features shown in the above referenced drawings are not intended to be drawn to scale nor are they intended to be shown in precise positional relationship. Like reference numbers indicate like elements.

DETAILED DESCRIPTION OF THE INVENTION

Figure 1:
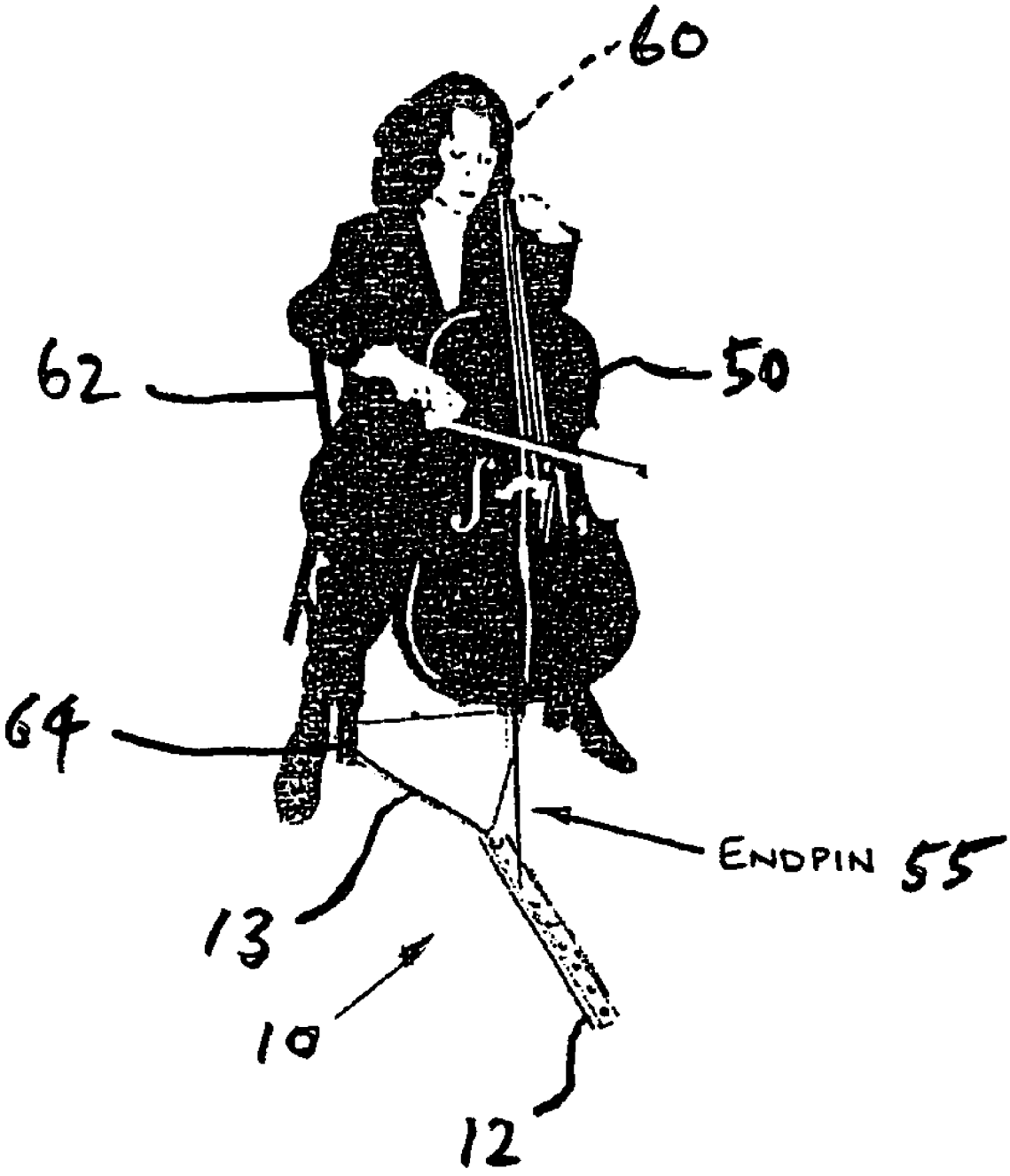
FIG. 1 is an illustration of a cello having an endpin held by a restraint in accordance with the present invention.

FIG. 1 is an illustration of the endpin restraint 10 according to an embodiment of the present invention being used in conjunction with a floor-resting musical instrument such as a cello 50. The endpin restraint 10 comprises an endpin holder 12 and a loop of flexible tension member 13. The cello 50 has an endpin 55 projecting from the bottom end thereof and is captively and removably received in the endpin holder 12. A cellist 60 generally positions the cello 50 in a slightly angled stance leaning into the cellist 60 while the cellist is seated in a chair 62. The chair 62 generally has at least a pair of front legs 64 and the endpin restraint 10 is anchored to the chair by having its flexible tension member 13 wrapped around the front legs 64 of the chair. Alternatively, if the chair has four legs, for example, the flexible tension member 13 may be wrapped around a pair of back legs (not shown) of the chair.

Figure 2:
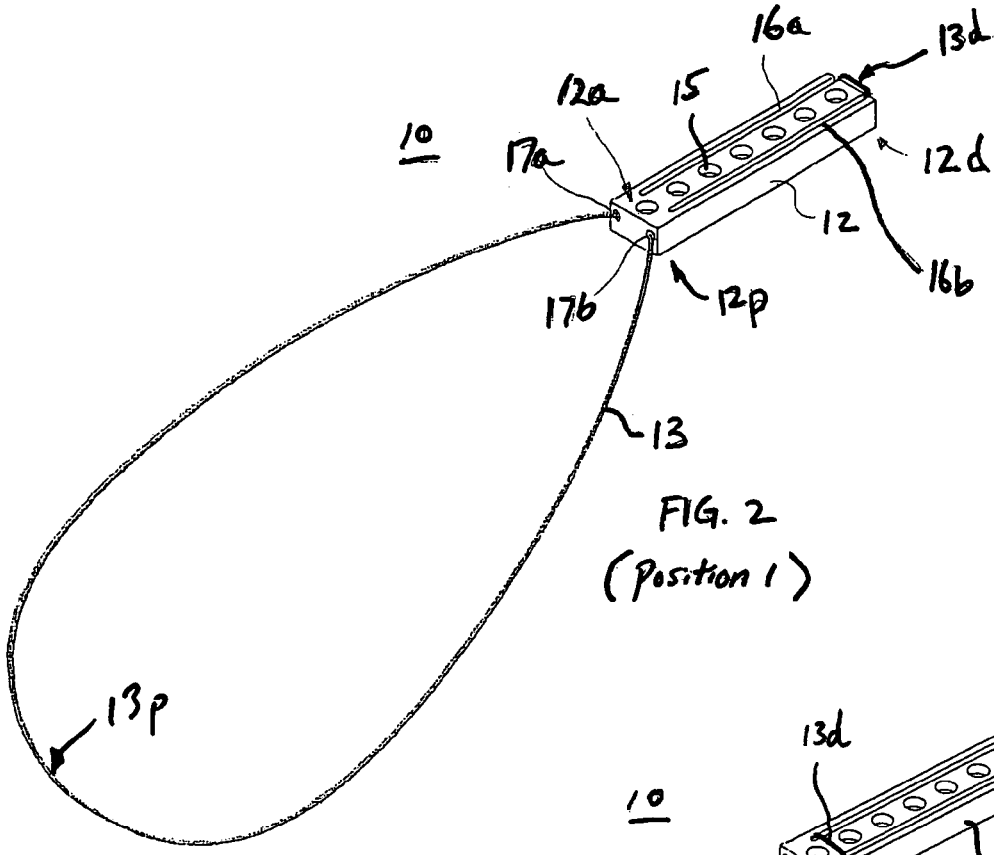
FIGS. 2-5 are illustrations of an embodiment of the endpin restraint in various configurations.
Figure 3:
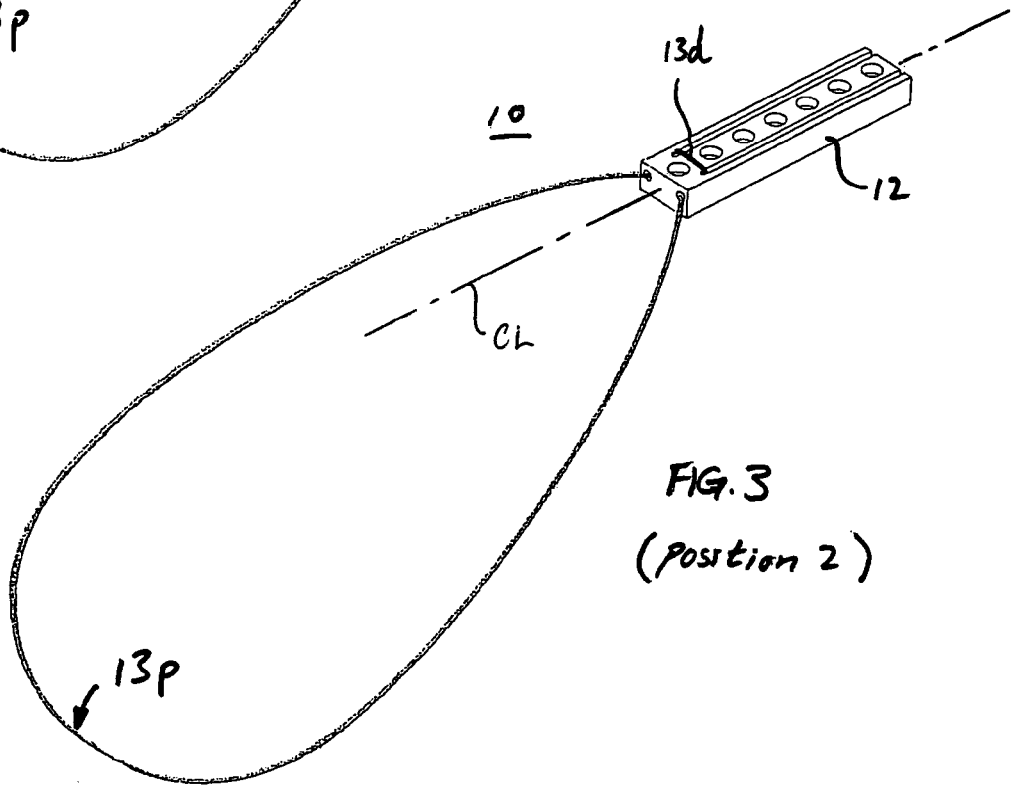

FIGS. 2 and 3 are detailed illustrations of an embodiment of the endpin restraint 10. The endpin holder 12 has an upper surface 12*a*, a proximal end 12*p* (the end closer to the musician) and a distal end 12*d* (the end away from the musician). In this example, the endpin holder 12 has a substantially rectangular shape but the endpin holder 12 can be of any desired shape and size.

On its upper surface 12*a*, the endpin holder 12 is provided with a plurality of endpin receiving structures 15. In this example, the endpin receiving structures 15 are pocket-like structures. The pockets 15 are of size and depth appropriate for the particular size of the endpin 55 to retain the endpin 55 in place and prevent the endpin 55 from coming out of the pocket 15 without lifting the musical instrument associated with the endpin such as the cello 50. The plurality of pockets 15 are provided in an arrangement forming at least one column of pockets extending from the proximal end 12*p* to the distal end 12*d* of the endpin holder 12. The musician 60 would adjust the distance between the musician and the cello 50, for example, by setting the endpin 55 of the cello 50 into a desired pocket among the plurality of pockets 15.

The endpin holder 12 is also provided with a pair of end holes 17*a*, 17*b* at its proximal end 12*b* and a pair of grooves or slots 16*a*, 16*b*. The slots 16*a*, 16*b* are provided in symmetric relation about the center line or the longitudinal axis CL (see FIG. 3) of the endpin holder 12 extend longitudinally along the length of the endpin holder 12. Each of the end holes 17*a*, 17*b* are communicatingly connected to the slots 16*a*, 16*b*, respectively. The loop of flexible tension member 13 is threaded through the end holes 17*a*, 17*b* and the slots 16*a*, 16*b*, respectively.

A musician would adjust the configuration of the endpin restraint 10 by adjusting the position of the flexible tension member 13 in the endpin holder 12 from position 1 illustrated in FIG. 2 and position 2 illustrated in FIG. 3. In position 1, the flexible tension member 13 is threaded through the full length of the slots 16*a*, 16*b* and the distal end 13*d* of the tension member 13 is looped around the distal end 12*d* of the endpin holder 12. In position 2, the flexible tension member 13 is pulled closer to the proximal end 12*p* of the endpin holder 12 so that the distal end 13*d* of the tension member 13 loops between the slots 16*a*, 16*b* near the proximal end 12*p* of the endpin holder 12. The length of the flexible tension member 13 would be selected so that the distance between the endpin holder 12 and the musician's chair is as desired. For example, in FIGS. 4 and 5, the distance between the endpin holder 12 and the chair is designated as D1, D2, respectively.

Figure 5:
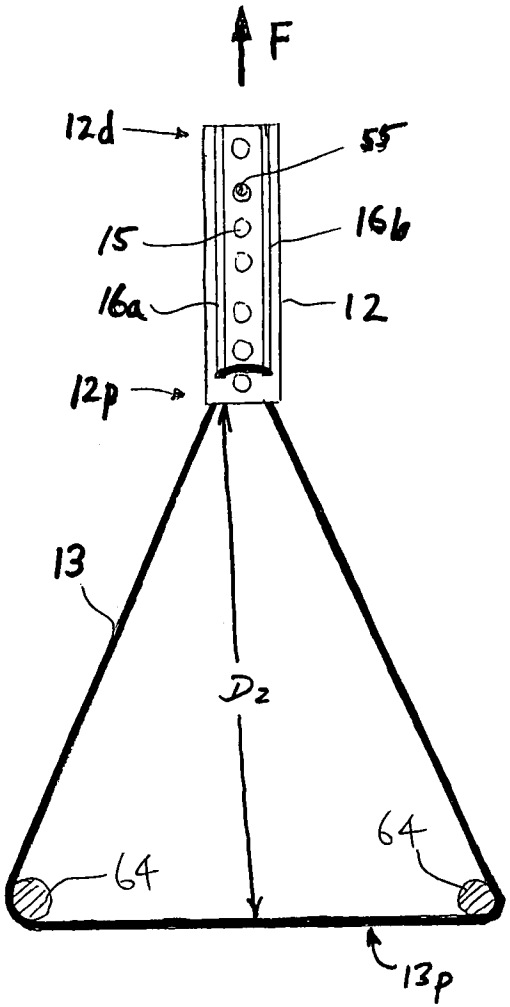
Figure 4:
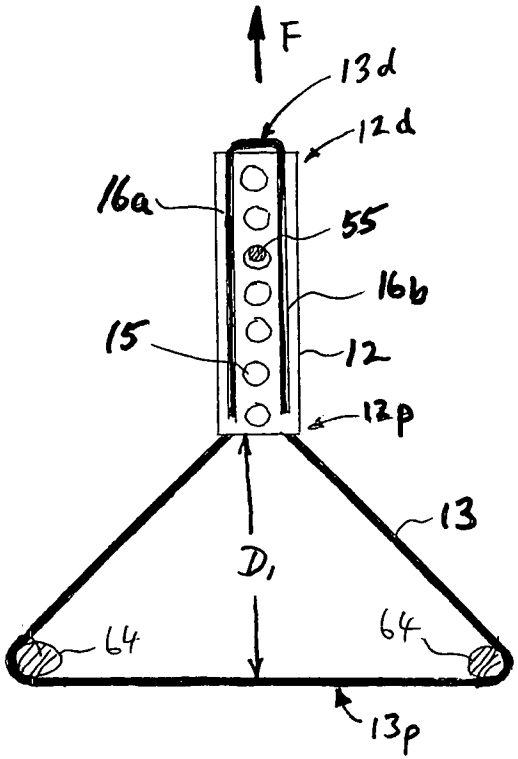
Figure 6:
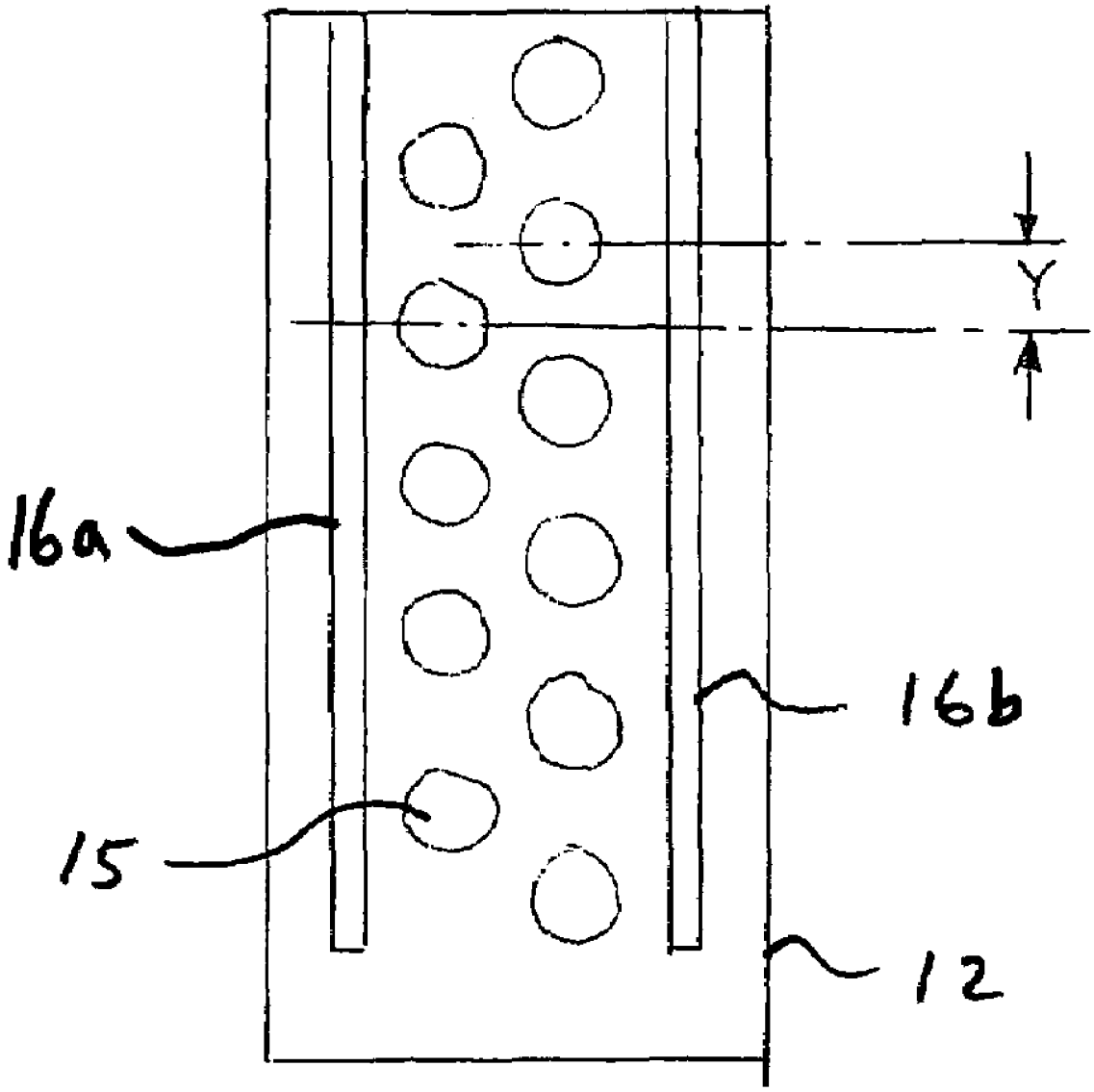
FIG. 6 is an illustration of an endpin holder having an alternate configuration of a plurality of pockets.

The top plan views of FIGS. 4 and 5 of positions 1 and 2, respectively, provide additional illustrations of how the flexible tension member 13 is threaded through the endpin holder 12. As illustrated, position 2 positions the endpin holder 12 further away from the musician's chair. The musician's chair is represented by its front legs 64. As shown in FIGS. 4 and 5, when the endpin restraint 10 is in use, the force F is exerted on the endpin holder 12 by the weight of the musical instrument 50 through its endpin 55. Without the endpin restraint 10, the force F would tend to make the endpin 55 slide along the floor away from the musician. During use, the flexible tension member 13 is maintained in tension by the force F. Because of the geometry involved in this configuration, the force F will push the endpin holder 12 in the direction of the force F until the particular pocket 15 (in this example the third one from the top in FIG. 4) in which the endpin 55 is placed is the furthest distance from the chair as possible with the given length of the flexible tension member 13. This is achieved when the flexible tension member 13 forms what is essentially an equilateral triangle configuration as shown in FIGS. 4 and 5 with the proximal end portion 13*p* of the flexible tension member 13 between the two legs 64 of the chair forming the base of the equilateral triangle Furthermore, for optimal stability of the endpin holder's position, i.e. prevent it from any yawing motion, the plurality of pockets 15 are provided in a single column along the longitudinal axis of the endpin holder 12 as illustrated in FIGS. 1-5. However, in an alternate embodiment, the plurality of pockets 15 may be provided in a staggered configuration as shown in FIG. 6. Such alternate configuration would provide more gradation in the selection of positions for the endpin because the spacing Y between each pocket in the longitudinal direction can be provided to be smaller than in the configuration shown in FIGS. 1-5.

Figure 7:
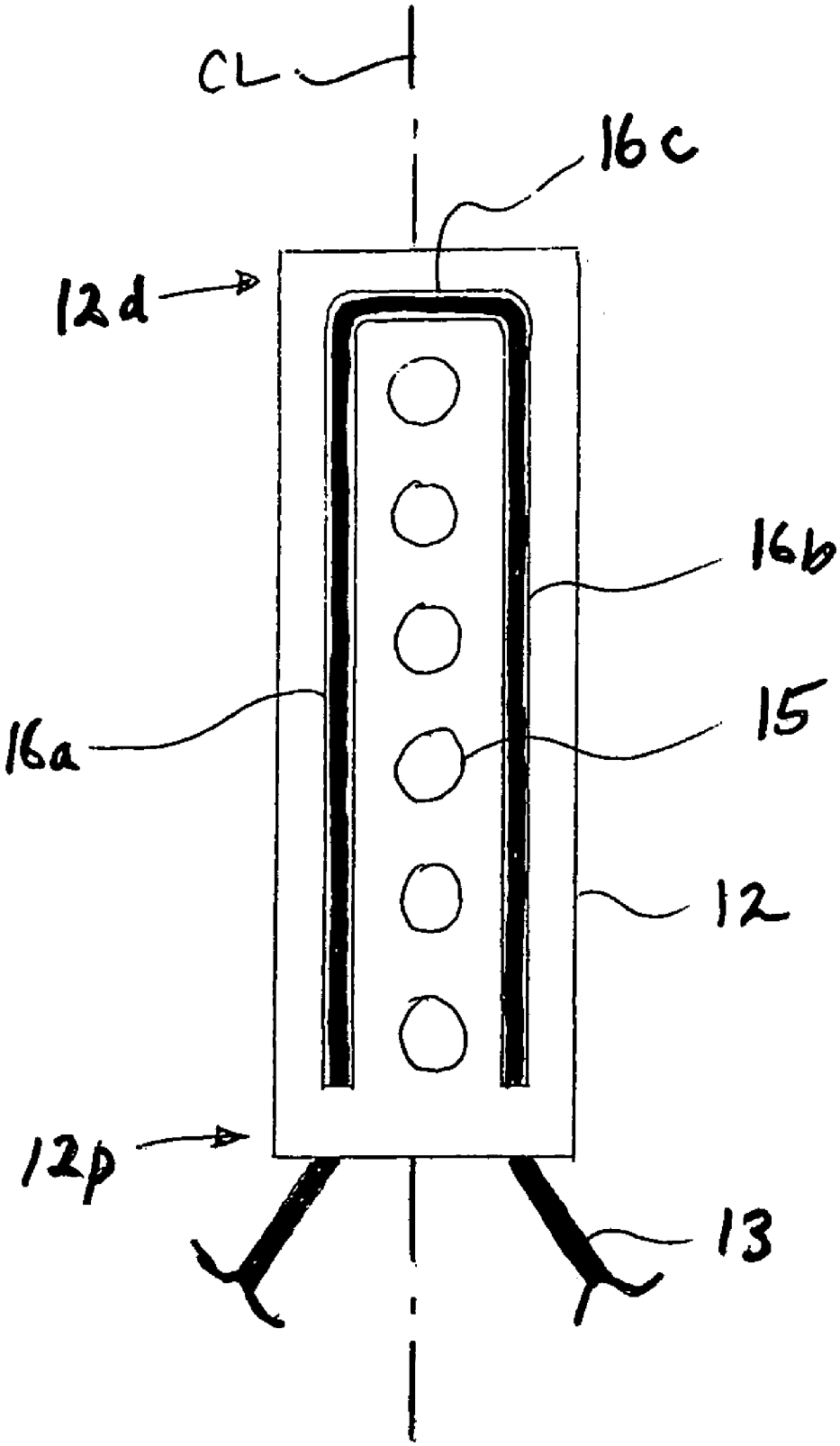
FIG. 7 is an illustration of another embodiment of the endpin holder of FIGS. 1-5.

Returning to the first embodiment of FIGS. 1-5, the slots 16*a*, 16*b* in this particular example start near the proximal end 12*p* and run off the edge at the distal end 12*d*. It is not necessary that the slots 16*a*, 16*b* run off the edge of the endpin holder 12 at the distal end 12*d* but the slots extend some substantial distance along the length of the endpin holder 12. This is because the slots 16*a*, 16*b* provide two-position adjustability for the endpin holder 12 increasing the range of the endpin positions for the musician 60. For example, in an alternate embodiment as illustrated in FIG. 7, the slots 16*a* and 16*b* are connected to each other near the distal end 12*d* of the endpin holder 12 by a slot connecting slot segment 16*c*. This allows the distal end 13*d* of the flexible tension member 13 to be looped through the slot segments 16*c* similar to the way the distal end 13*d* of the flexible tension member 13 loops around the distal end 12*d* of the endpin holder 12 in the first embodiment of FIGS. 1-5. The slots provided in the endpin holder 12 enables the flexible tension member 13 to be secured to the endpin holder and also provide ways to adjust the length of the flexible tension member 13, which in turn adjusts the distance between the endpin holder 12 and the musician's chair.

The endpin holder 12 can be fabricated from any material. Preferably, the endpin holder 12 is fabricated from rigid material such as wood, plastic, hard rubber or metal. However, the present invention is not limited to the endpin holders made from rigid material. In a preferred embodiment, the endpin holder 12 is fabricated from hardwood such as oak, maple, ebony, etc. so that the endpin holder 12 minimally affect the sound of the musical instrument transmitted through the endpin.

Figure 8:
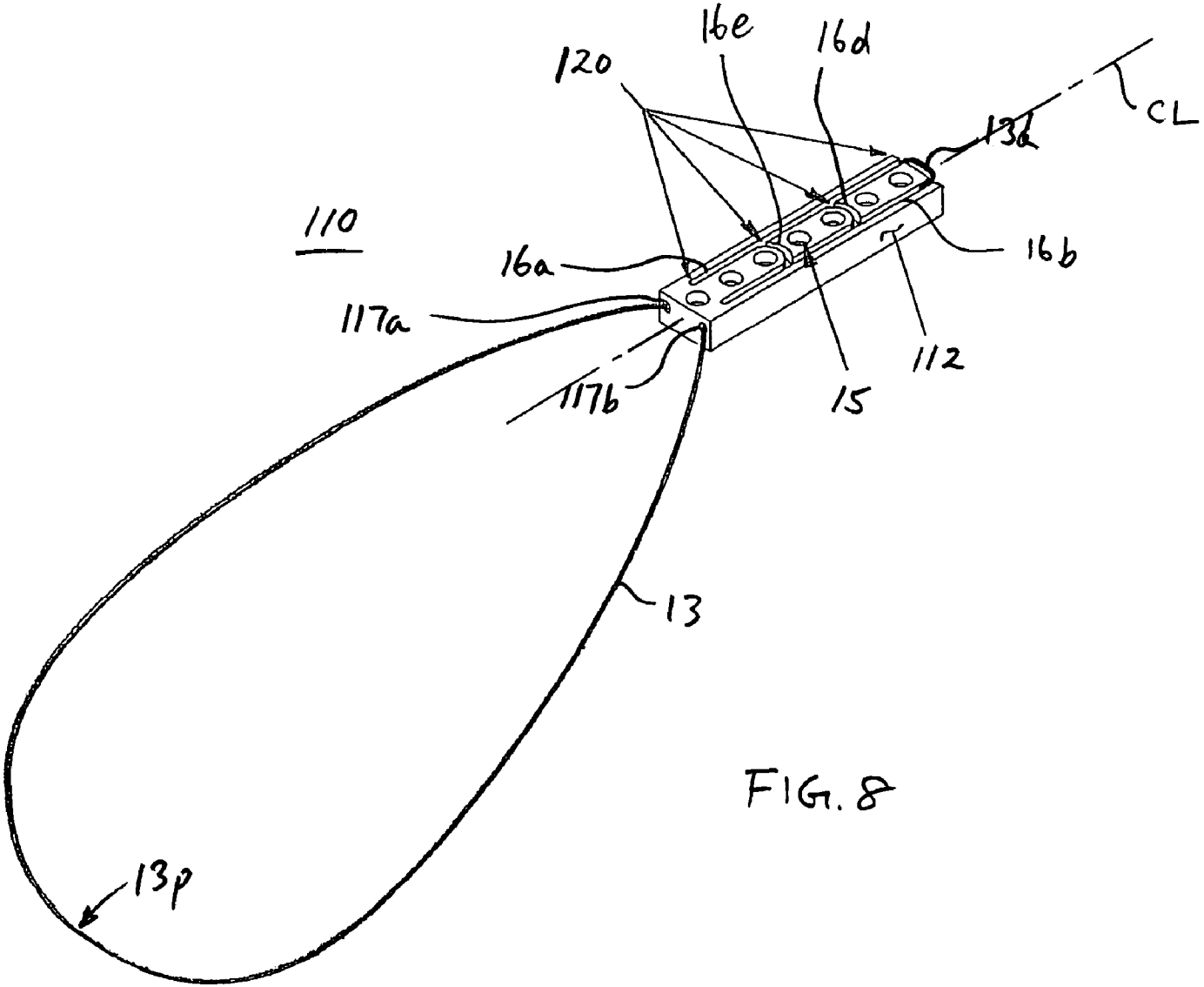
FIGS. 8-21 are illustrations of additional embodiments of the endpin restraint.

FIG. 8 is an illustration of another embodiment of endpin restraint 110. In this embodiment, the endpin holder 112 is provided with one or more additional connecting slots between the slots 16*a* and 16*b* for threading the flexible tension member 13. In FIG. 8, two connecting slots 16*d* and 16*e* are provided in the endpin holder 112 as an example. In comparison to the endpin holder 12 illustrated in FIGS. 4 and 5, the endpin holder 112 of FIG. 8 provides two additional positions for configuring the endpin restraint 110. Thus, the musician has a choice of four positions identified by the arrows 120, to thread the flexible tension member 13 in the endpin holder 112.

Figure 9:
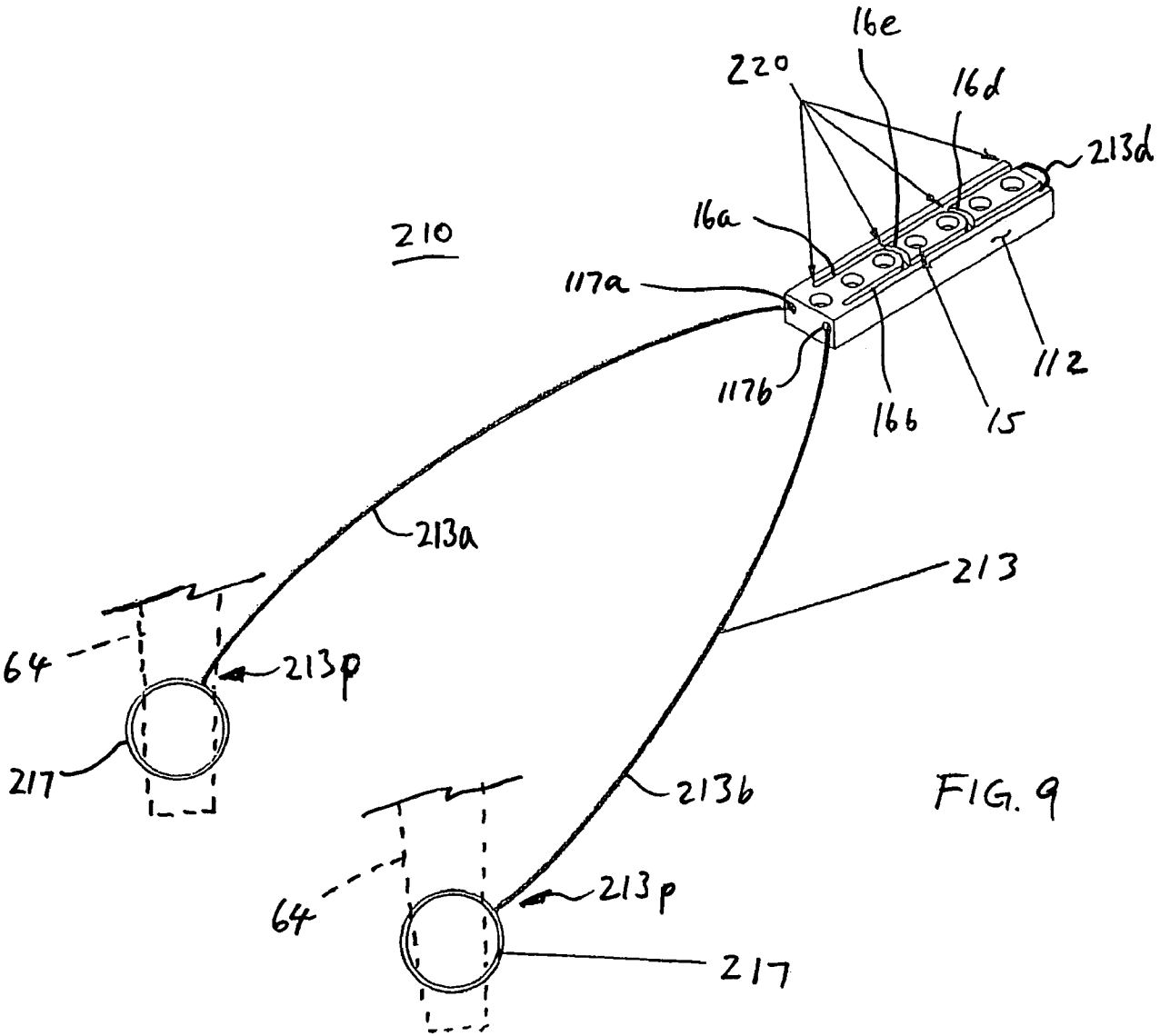

FIG. 9 is an illustration of another embodiment of endpin restraint 210. In this embodiment, the endpin holder 112 is same as the one illustrated in FIG. 8. However, the flexible tension member 213 is not a continuous loop like the flexible tension member 13 but an open ended one. The flexible tension member 213 thus has two segments 213*a*, 213*b* and is open ended at the proximal end (near to the musician). Thus, the two segments 213*a*, 213*b* have terminal ends at their proximal ends 213*p*. Similar to the embodiment of FIGS. 1-5, the position of the distal end (away from the musician) 213*d* of the flexible tension member 213 can be changed to adjust the position of the endpin holder 112 with respect to the musician. However, in this embodiment the endpin holder 112 is provided with connecting slots 16*d* and 16*e* between the longitudinal slots 16*a* and 16*b* to provide additional positions for the distal end 213*d* of the flexible tension member. Thus, the distal end 213*d* of the flexible tension member 213 can be placed in one of the four positions identified by the arrows 220. Each of the terminal ends 213*p* is adapted and configured to receive one of the two front legs 64 of the musician's chair. This may be achieved by providing a ring 217 at each of the terminal ends 213*p* as shown so that the flexible tension member 213 can be secured to the front legs 64 of the musician's chair by inserting one of the two front legs 64 into one of the rings 217. Alternatively, each of the terminal ends may be tied into a loop (not shown) which will serve the same function as the rings 217.

Figure 10:
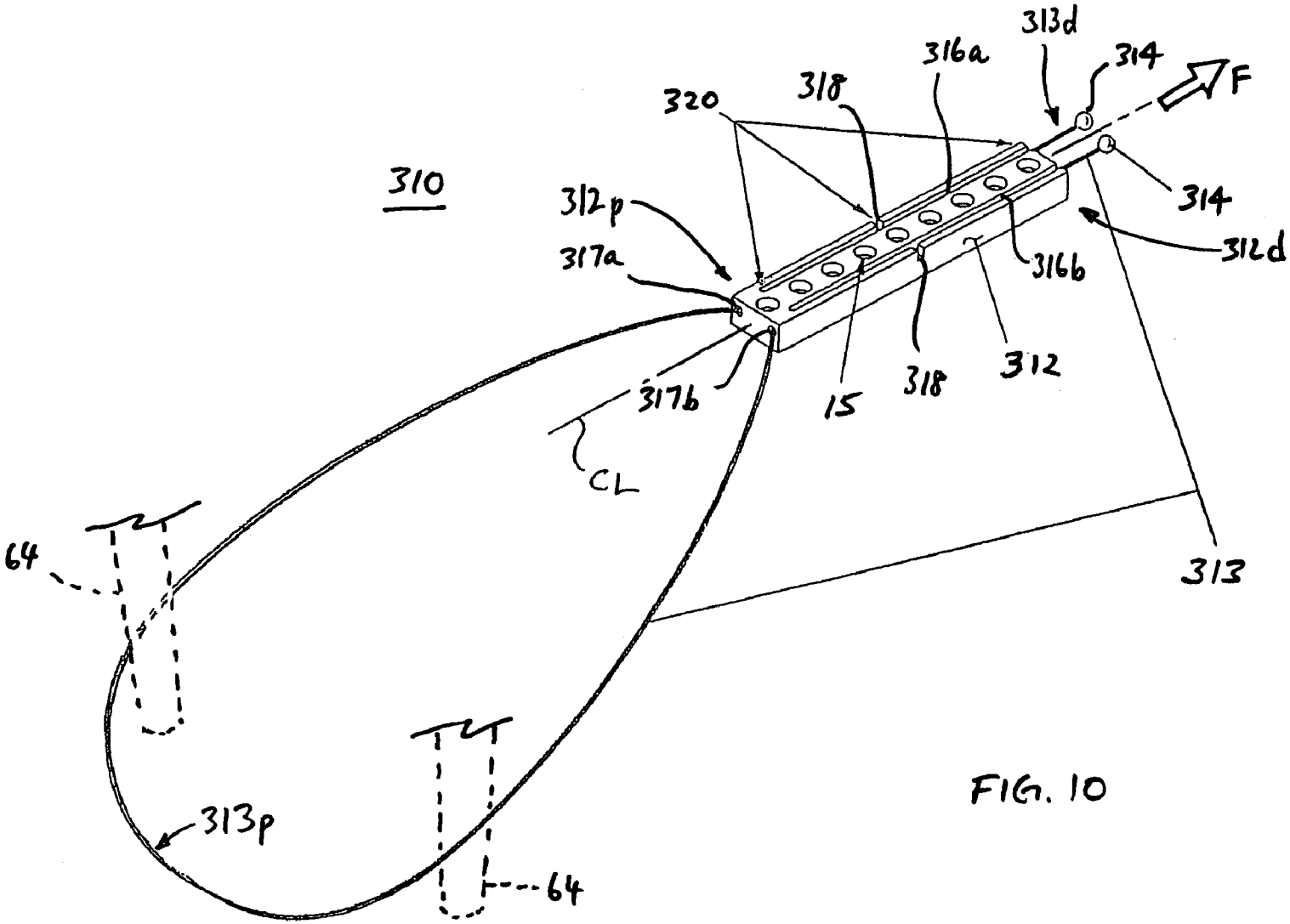

Referring to FIG. 10, another embodiment of endpin restraint 310 is illustrated. The endpin restraint 310 comprises an endpin holder 312 and a flexible tension member 313. The endpin holder 312 is provided with a pair of longitudinally running slots 316*a*, 316*b* and a pair of end holes 317*a*, 317*b* at its proximal end 312*p*. The end holes 317*a* and 317*b* are communicatingly connected to the slots 316*a* and 316*b*, respectively for threading the flexible tension member 313 therethrough. The flexible tension member 313 is an open-ended loop and the two ends of the flexible tension member 313 are threaded through the end holes 317*a* and 317*b* and then through the slots 316*a* and 316*b*, respectively, and exiting at the distal end 312*d* of the endpin holder 312. The two ends of the flexible tension member 313 are provided with stops 314. The stops 314 may be formed of any appropriate material such as wood, metal, glass, plastic, etc. and may come in a variety of shapes and sizes. The stops 314 may be attached to the flexible tension member 313 in any appropriate manner as long as the stops 314 are attached sufficiently securely to the ends of the tension member 313 to prevent them from coming off during use. For example, the stops 314 may be beads of appropriate size having a hole therethrough and secured to the flexible tension member 313 by threading an end of the tension member 313 through the bead and tying it. In another example, the stops 314 may be made of metal, glass, or plastic and they may be molded onto the ends of the tension member 313.

The two ends of the flexible tension member 313 are threaded through the end holes 317*a*, 317*b* and the flexible tension member 313 are laid within the longitudinal slots 316*a*, 316*b* so that the stops 314 reside beyond the distal ends of the longitudinal slots 316*a* and 316*b*. The stops 314 are larger than the width of each of the slots 316*a*, 316*b* so that when the tension member 313 is pulled tight by the force F exerted on the endpin holder 312 by the endpin of a musical instrument, the stops 314 will abut against the endpin holder 312 and prevent the open ends of the tension member 313 from being pulled through. In use, the proximal end 313*p* of the tension member 313 is looped around two front legs 64 of a musician's chair.

Figure 12:
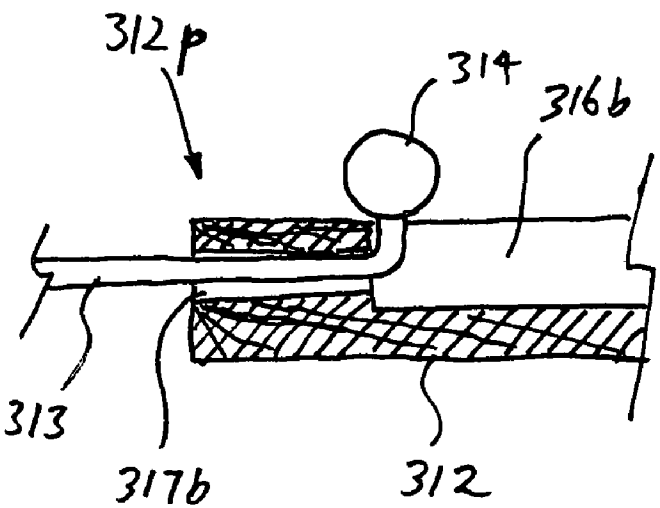
Figure 11:
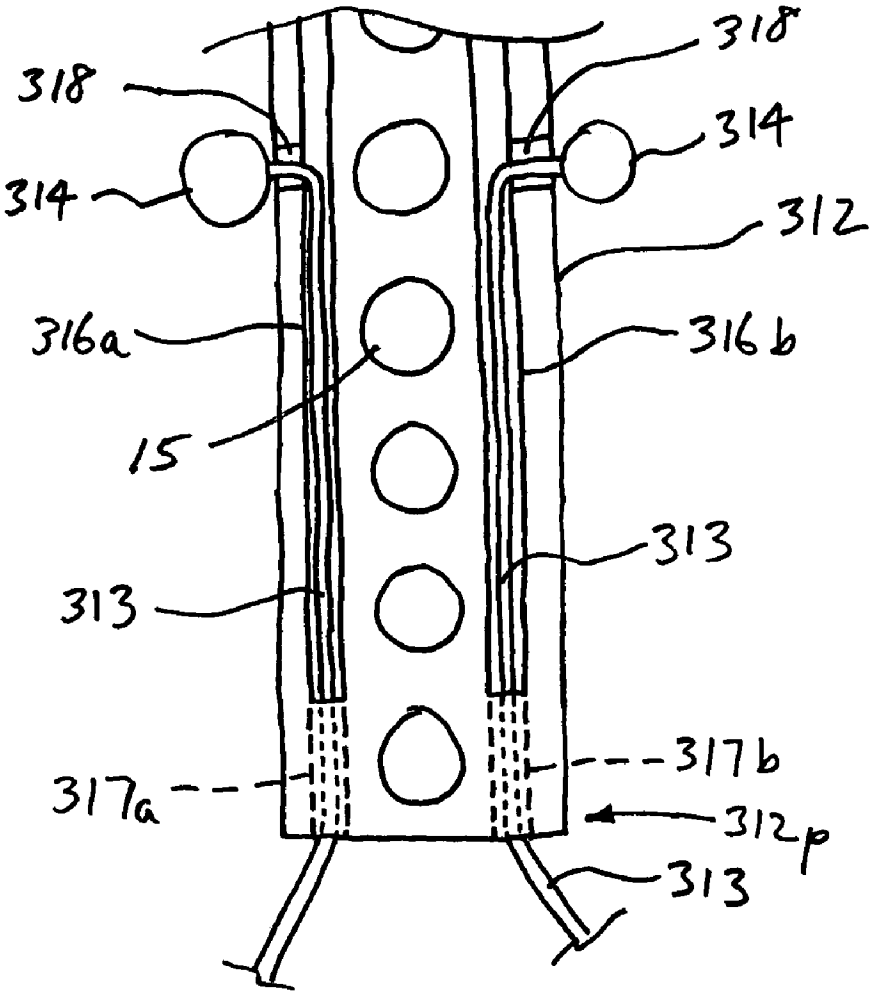

Along the length of the endpin holder 312, one or more side slots 318 may be provided to lock the stops 314 at their intermediate positions. In the embodiment of FIG. 10, one side slot 318 is provided on each side of the endpin holder 312 associated with each of the longitudinal slots 316*a*, 316*b*. To lock the stops 314 at their intermediate positions, each of the two ends of the flexible tension member 313 are threaded along the slots 316*a*, 316*b* up to the side slots 318, then threaded outward through the side slots 318 and let the stops 314 hang outside. The side slots 318 are preferably smaller than the stops 314 so that when the flexible tension member 313 is pulled tight by force F exerted on the endpin holder 312 by the endpin of a cello for example, the stops 314 interfere with the side slots 318 and prevent the flexible tension member 313 from being pulled through, thus, holding the endpin holder 312 in this intermediate position. This configuration is illustrated in the plan view shown in FIG. 11. To increase the distance between the endpin holder 312 and the musician further, the ends of the flexible tension member 313 are withdrawn from the side slots 318 and allow the two ends of the tension member 313 to be drawn further through the end holes 317*a* and 317*b* until the stops 314 reach the proximal ends of the slots 316*a* and 316*b*. This position is illustrated in the cross-sectional view of the longitudinal slot 316*b* shown in FIG. 12. FIG. 12 is a longitudinal cross-section of the endpin holder 312 taken through the slot 316*b* near the proximal end 312*p*. The flexible tension member 313 is shown as being threaded through the hole 317*b* which is communicatingly connected to the longitudinal slot 316*b*. The stop 314, which is preferably larger than the width of the slot 316*b* prevents the flexible tension member 313 from being drawn through the slot 316*b* and the hole 317*b*.

Figure 13:
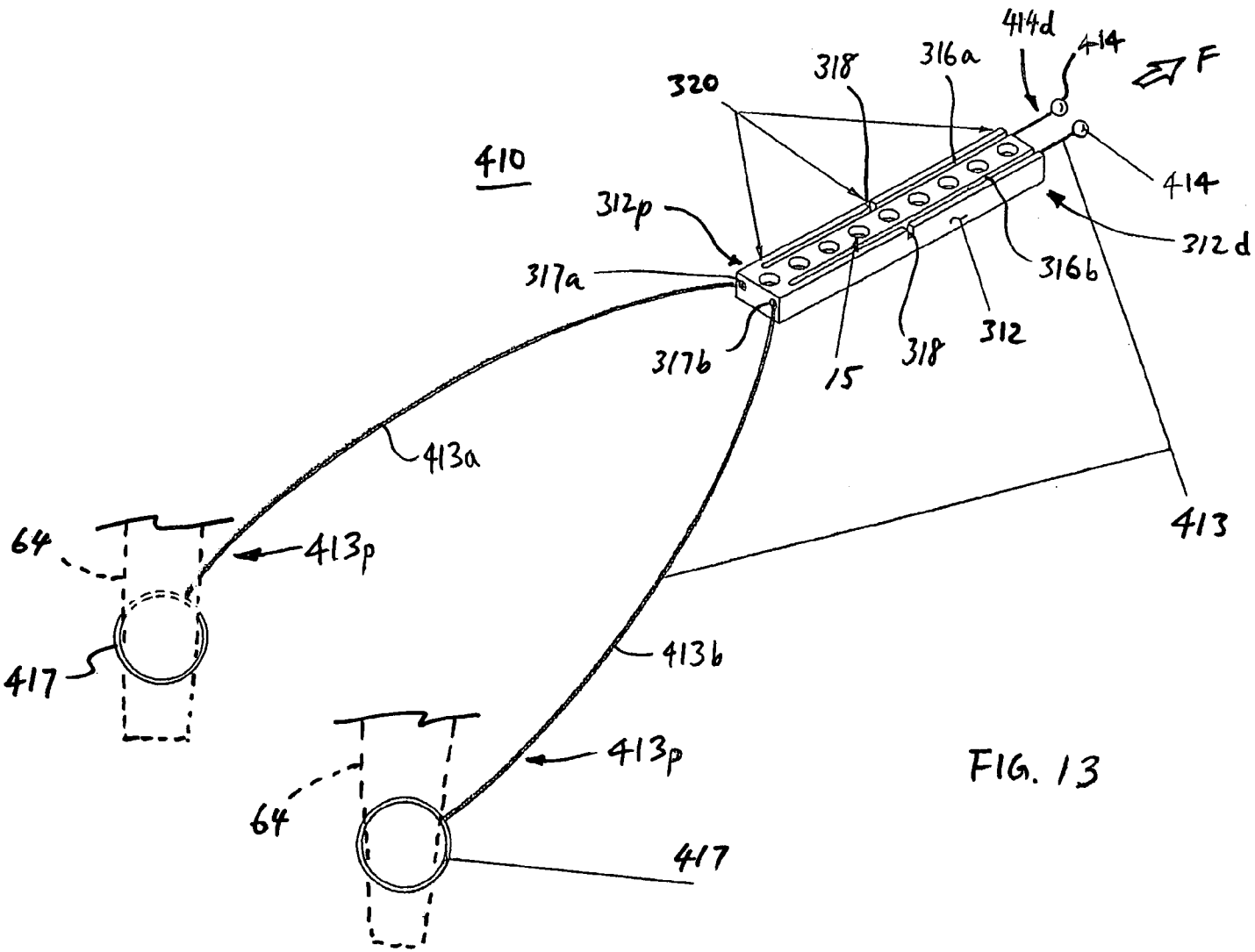

FIG. 13 illustrates another embodiment of the endpin restraint 410. The endpin restraint 410 according to this embodiment comprises the same endpin holder 312 of FIG. 10 and a flexible tension member 413. The tension member 413 is open ended at its distal end 413*d* with stops 414 at the two ends similar to the tension member 313 of the endpin restraint 310. However, the tension member 413 is also open ended at its proximal end 413*p*. Thus, the tension member 413 comprises two-pieces 413*a* and 413*b*. Similar to the tension member 213 of FIG. 9, a ring 417 is provided at each of the two proximal ends 413*p* of the tension member 413. The endpin restraint 410 is secured to the front legs 64 of the musician's chair by inserting each of the two front legs 64 of the chair into the rings 417. The force F exerted on the endpin holder 312 by the endpin of a musical instrument will keep the two parts 413*a* and 413*b* of the tension member 413 taut and keeps the endpin holder 312 centered with respect to the musician's chair.

Figure 31:
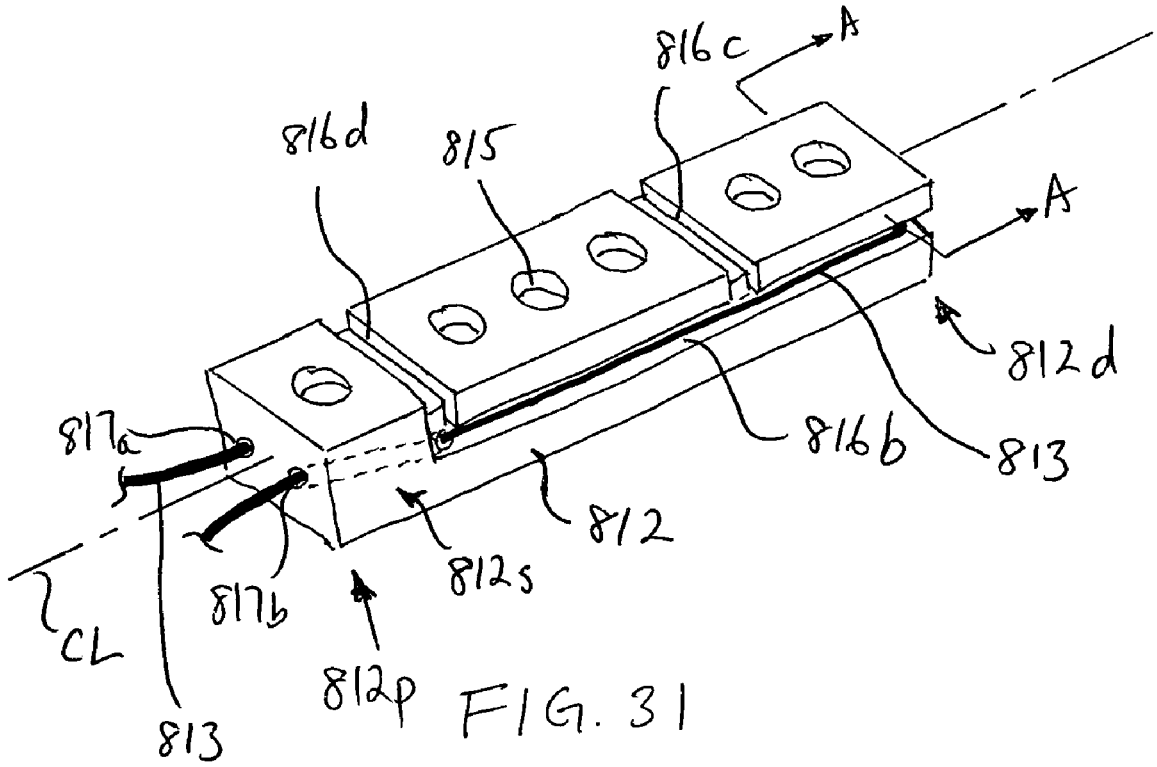
FIG. 31 is a perspective view of another illustrative embodiment of an endpin holder.
Figure 32:
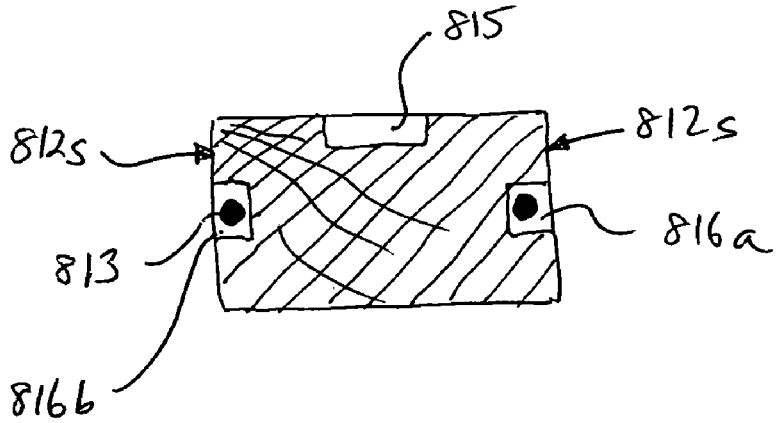
FIG. 32 is a cross-sectional view of the endpin holder of FIG. 31.

The location of the longitudinal slots 16*a*, 16*b*, 316*a*, 316*b* of the illustrative embodiments shown in FIGS. 1-13 may not be limited to the upper surface of the endpin holders. The longitudinal slots can be provided along the side surfaces of the endpin holders. FIGS. 31 and 32 illustrate an embodiment of such endpin holder 812. The endpin holder 812 is substantially rectangular in shape extending between its proximal end 812*p* and distal end 812*d*. A plurality of endpin receiving structures 815 are provided in a linear configuration on its upper surface. A pair of longitudinally extending slots are provided on each of the two side surfaces 812*s* of the endpin holder 812. FIG. 32, which is a cross-sectional view of the endpin holder 812 through line A-A shown in FIG. 31 shows both of the side surfaces 812*s* and the pair of longitudinal slots 816*a* and 816*b*. Provided at the proximal end 812*p* of the endpin holder 812 are end holes 817*a*, 817*b* that are each communicatingly connected to their respective longitudinal slots 816*a*, 816*b*. A flexible tension member 813 would be threaded through these endholes and looped around the longitudinal slots 816*a*, 816*b*. Additional one or more connecting slots such as 816*c* and 816*d* shown may be provided on the endpin holder 812 also. Such additional connecting slots provide additional looping/threading paths for the flexible tension member 813 and allow the user to adjust the length of the flexible tension member 813 between the endpin holder 812 and the musician's chair (not shown). The function of the connecting slots 816*c*, 816*d* are analogous to the function of the connecting slots 16*d*, 16*e* of embodiment shown in FIG. 8.

Figures 14, 15, 16:
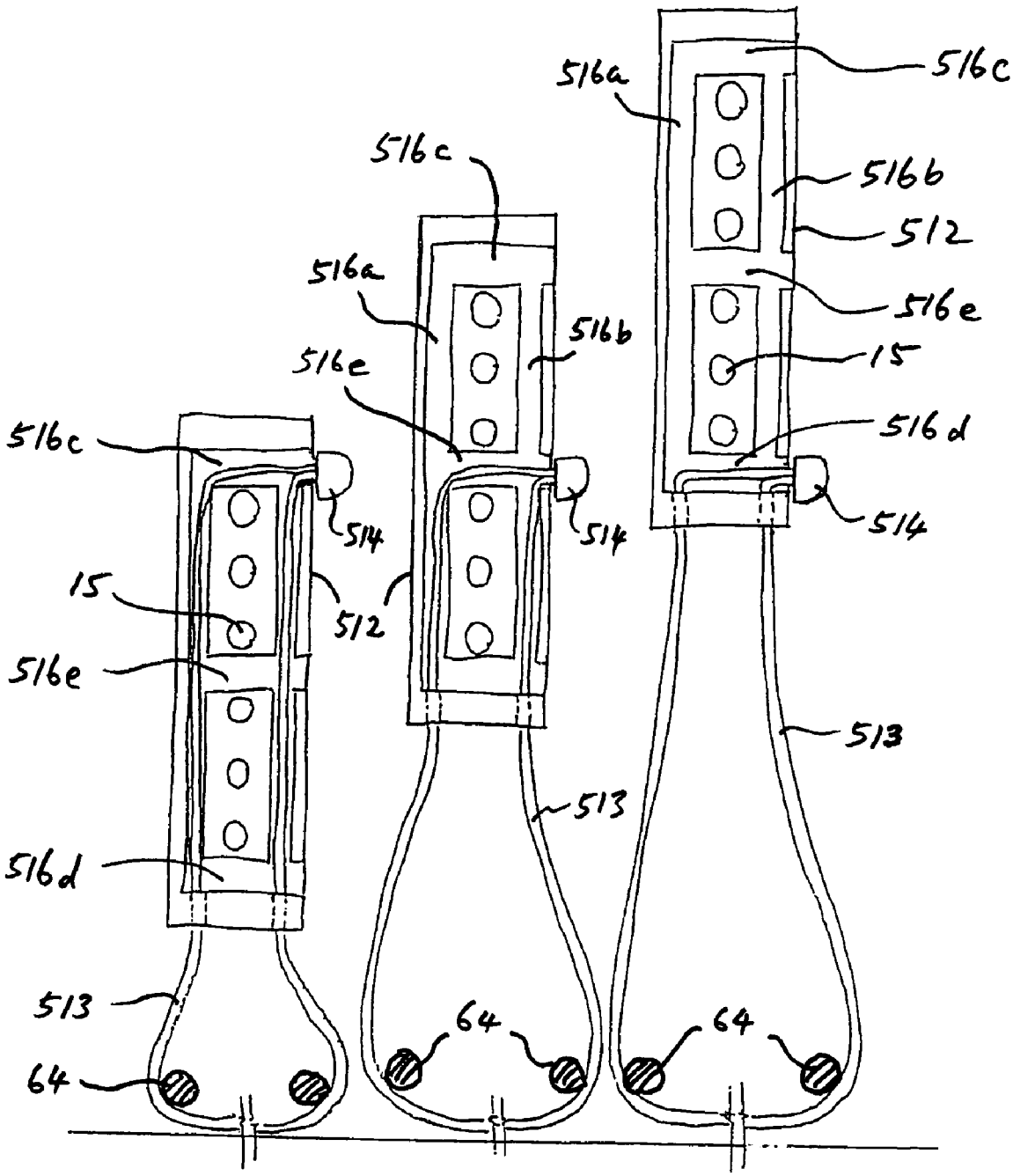

FIGS. 14, 15, and 16 illustrate yet another embodiment of endpin restraint 510. The endpin restraint 510 is a variation of the endpin restraint 110 shown in FIG. 8. The endpin restraint 510 comprises an endpin holder 512 and a flexible tension member 513. The tension member 513 is a loop with a stop 514 attached to the tension member 513 near the tension member's distal end. The endpin holder 512 is provided with pockets 15 on its upper surface for receiving the endpin of a musical instrument such as a cello. The endpin holder 512 further includes two longitudinal slots 516*a*, 516*b* and at least two connecting slots 516*c* and 516*d* connecting the slots 516*a* and 516*b* near their terminal ends. The connecting slots are sufficiently long so that they extend beyond the distance between the longitudinal slots 516*a*, 516*b* and are open to at least one side of the endpin holder 512. In the examples illustrated in FIGS. 14-16 the connecting slots 516*c*, 516*d*, 516*e* extend beyond the slot 516*b* and are open to the right side of the endpin holder 512. Whether the connecting slots open to the right side or left side of the endpin holder 512 is a matter of design choice.

The two connecting slots 516*c* and 516*d* provides two extreme positions for the endpin holder 512 with respect to the musician's chair (represented by the front legs 64 of the chair). Positioning the stop 514 of the flexible tension member 513 in the connecting slot 516*c* at the distal end of the endpin holder 512 results in the endpin holder 512 being closest to the musician's chair (compare FIG. 14 to FIGS. 15 and 16). Positioning the stop 514 of the flexible tension member 513 in the connecting slot 516*d* at the proximal end 512*p* of the endpin holder 512 results in the endpin holder 512 being furthest from the musician's chair. More gradation in the position of the endpin holder 512 can be achieved by providing one or more of the intermediate connecting slot 516*e* between the connecting slots 516*c* and 516*d*. FIG. 15 illustrates the intermediate position of the endpin holder 512 achieved by positioning the stop 514 of the flexible tension member 513 in the intermediate connecting slot 516*e*. The tension member 513 is shown wrapped around the two front legs 64 of the musician's chair.

As illustrated by the exemplary embodiments shown and discussed so far, the benefit of the endpin restraint of the present invention is that the distance between the endpin holder and the musician can be adjusted without the use of any additional components (e.g., buckles, slides, etc.) other than the endpin holder itself. By threading, winding or wrapping the flexible tension member within the endpin holder, the length of the flexible tension member is adjusted and in turn adjusts the distance between the endpin holder and the musician's chair.

Shown in FIGS. 17-21 is another embodiment of an endpin holder 612. The endpin holder 612 includes a plurality of pockets 15 on its upper surface for receiving an endpin of a musical instrument such as a cello. As with the other embodiments of the endpin holders discussed above, a pair of longitudinal slots 616*a*, 616*b* are provided on the upper surface of the endpin holder 612 for threading a flexible tension member 613 therewithin. The endpin holder 612 has end holes 617*a*, 617*b* at its proximal end that are communicatingly connected to the slots 616*a*, 616*b* respectively. The tension member 613 is open ended at the distal end similar to the tension member 313 in FIG. 10. Stops 614, similar to the stops 314 of FIG. 10, are provided at each of the two ends of the tension member 613 in similar manner as discussed in reference to FIGS. 10-12. Along the lengths of the longitudinal slots 616*a*, 616*b*, at least one pair of side slots 618 are provided as shown.

Figures 17, 18, 19, 20, 21:
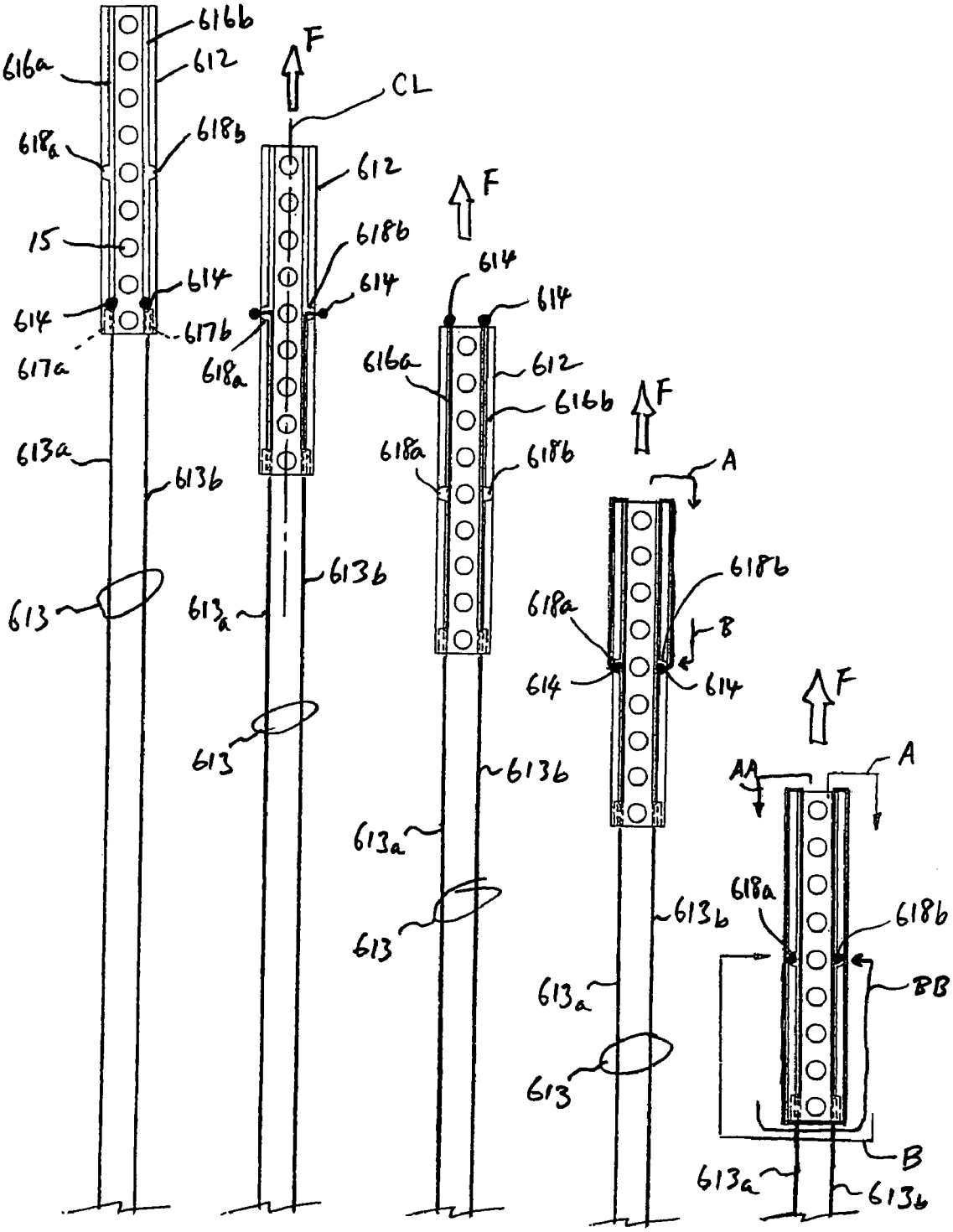

The side slots 618 are shaped such that the stops 614 at the two ends of the tension member 613*a*, 613*b*, can be accommodated within the side slots 618 as shown in FIGS. 20 and 21. The side slots 618 allows the musician to thread or wrap the tension member 613 in various different configurations within the endpin holder 612 to adjust the distance between the endpin holder 612 and the musician's chair in at least four different positions as illustrated by each of the FIGS. 17-21. The configuration shown in FIG. 17 positions the endpin holder 612 furthest away from the musician's chair (not shown but would be at the bottom of FIG. 17). In this configuration the endpin holder 612 is fully extended away from the musician's chair until the flexible tension segments 613*a*, 613*b* are taut and the stops 614 are at the proximal ends of the slots 616*a* and 616*b*.

The configuration shown in FIG. 18 positions the endpin holder 612 incrementally closer to the musician's chair. In this configuration, the endpin holder 612 is pulled closer to the musician until the two ends of the flexible tension member 613*a*, 613*b* can be inserted into the side slots 618 so that the stops 614 are positioned outer side of the side slots 618 as shown. The stops 614 are preferably larger in size than the side slots 618 and the stops 614 will maintain the position of the endpin holder 612 against the force F exerted by the endpin of a musical instrument.

The configuration shown in FIG. 19 positions the endpin holder 612 further towards the musician's chair. In this configuration, the endpin holder 612 is pulled closer to the musician until the two ends of the flexible tension member 613*a*, 613*b* are threaded through the longitudinal slots 616*a*, 616*b* and out at the distal end of the endpin holder 612 so that the stops 614 are braced against the slots 616*a* and 616*b*.

The configuration shown in FIG. 20 positions the endpin holder 612 further towards the musician's chair from the position of FIG. 19. In this configuration, the flexible tension members 613*a*, 613*b* are threaded through the full length of the longitudinal slots 616*a*, 616*b*, respectively, and wrapped around the outer surface of the endpin holder 612 following the arrows A and B until the stops 614 reaches the side slots 618. As mentioned previously, the side slots 618 are shaped and sized to receive the stops 614. The stops 614 are inserted into the side slots 618 as shown. That secures the flexible tension member 613 in this configuration and secures the endpin holder 612 in this position against the force F exerted on the endpin holder 612 by the endpin of a musical instrument whose free end is received in one of the plurality of pockets 15.

The configuration shown in FIG. 21 positions the endpin holder 612 even further closer towards the musician's chair from the position of FIG. 20. In this configuration, the flexible tension members 613*a*, 613*b* are threaded through the full length of the longitudinal slots 616*a*, 616*b* as in the configuration of FIG. 20. But, the tension members 613*a*, 613*b* are wrapped around the outside of the endpin holder 612 following a longer path in order to take up more of the tension member's length. For example, the tension member segment 613*a* is wrapped around the endpin holder 612 following the path denoted by the arrows AA and BB and the stop 614 at the end of the tension member segment 613*a* is inserted into the side slot 618*b* on the opposite side of the endpin holder 612. The tension member segment 613*b* follows a mirror image path. That is, the tension member segment 613*b* is wrapped around the endpin holder 612 following the path denoted by the arrows A and B and the stop 614 at the end of the tension member segment 613*b* is inserted into the side slot 618*a* on the opposite side of the endpin holder 612. In the embodiment shown in FIGS. 17-21, the proximal end (the end near the musician's chair which is not shown) of the flexible tension member 613 may be a continuous loop or be open ended having two ends provided with rings for receiving the front legs of the musician's chair, similar to the tension member 413 of FIG. 13.

Figure 22:
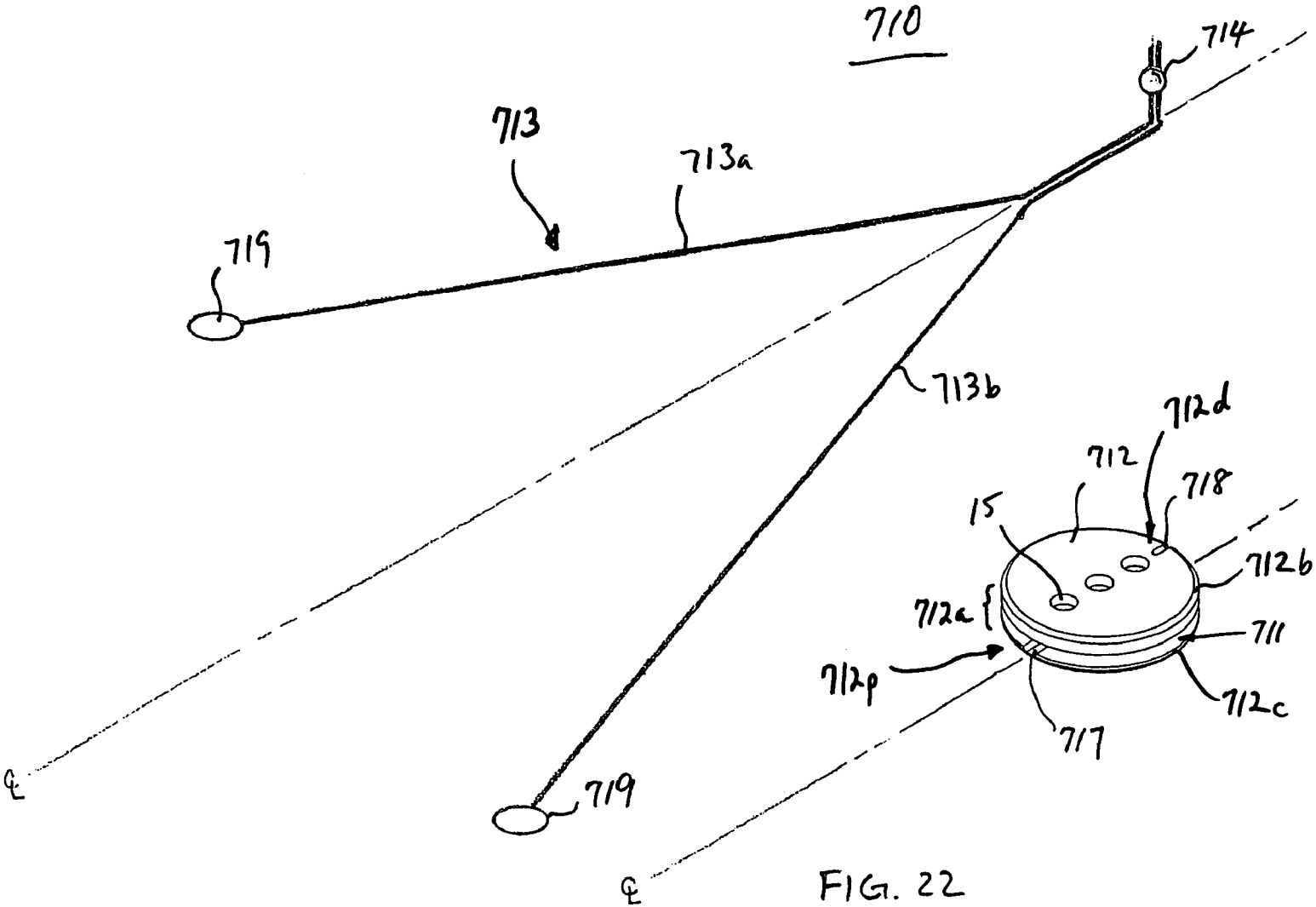

The endpin holders 12, 112, 312, 512, 612, 812 may be fabricated in any shape and not limited to the generally rectangular shapes illustrated as examples in FIGS. 1-21. For example, the endpin holder may be shaped as the musical instrument such as a cello. In the illustrative embodiment shown in FIGS. 22-28, an endpin restraint 710 including an endpin holder 712 having a round disk-like shape is shown. Referring to FIG. 22, the endpin restraint 710 comprises an endpin holder 712 and a flexible tension member 713. The endpin holder 712 has a disk-like shape with a plurality of pockets 15 for receiving an endpin of a musical instrument in its upper surface. A slot 711 is provided along the vertical side surface 712*a* so that the slot 711 extends the full circumference of the endpin holder 712. The circumferentially running slot 711 divides the body of the endpin holder 712 into upper portion 712*b* and a lower portion 712*c*. Generally, the lower portion 712*c* rests on the floor during use. A hole 717 is provided and it extends along the center line CL through the center of the endpin holder 712. One end of the hole 717 defining a proximal end 712*p* and the other end of the hole 717 defining a distal end 712*d* of the endpin holder 712. Because the hole 717 is positioned along the center line CL of the endpin holder 712, this configuration provides the symmetry necessary to enable the endpin restraint's self-centering characteristic under the force F exerted by the endpin of the musical instrument (see FIG. 27). This is similar to the symmetry provided in the embodiments of FIGS. 1-21 by the pair of longitudinal slots being positioned symmetrically about the longitudinal axis CL of the endpin holders. One or more locking slots 718 may be provided in the upper portion 712*b* of the endpin holder 712 near its distal end 712*d*.

Again, it should be noted that the endpin holders can be provided in any desired outline shape and even in the illustrative embodiment of FIGS. 22-28, the endpin holder 712 need not be limited to the disk-like shape. The endpin holder 712 may have a triangular, square, pentagon, or any regular polygonal or irregular shape outline as desired. To that end, the term "circumference" and "circumferentially" used herein means perimeter of any shaped endpin holder.

The particular example of the tension member 713 shown is an open-ended one. At the distal end of the tension member 713 is provided a stop 714 similar to the stops 314 and 414 described herein. From the stop 714, two segments 713*a*, 713*b* of the tension member 713 extends to their proximal ends. At the proximal ends of the tension member segments 713*a*, 713*b*, rings 719 are provided for receiving the front legs of the musician's chair.

Figure 23:
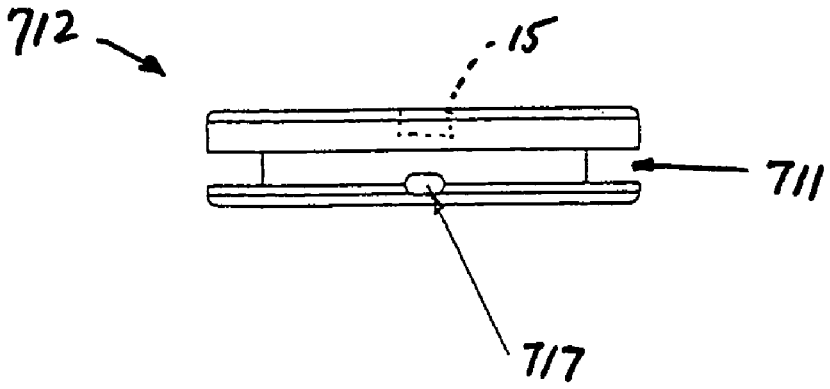
Figure 24:
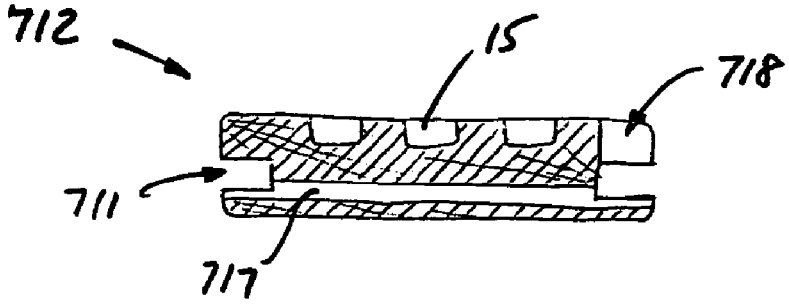

FIG. 23 is an end view illustration of the endpin holder 712 viewed along the center line CL FIG. 24 is a cross-sectional view of the endpin holder 712 taken vertically along the center line CL. In these illustrations, the hole 717 can be seen extending through the length of the endpin holder 712. The plurality of pockets 15 may be provided in any configuration but preferably the pockets 15 are aligned linearly along the center line CL as shown in FIGS. 22-24.

Figure 29:
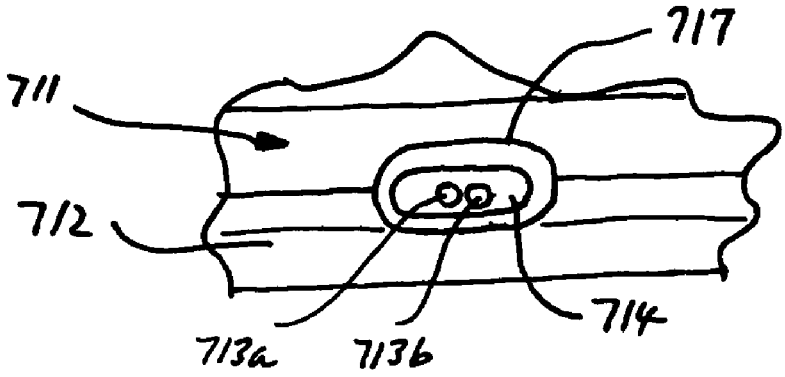
Figure 30:
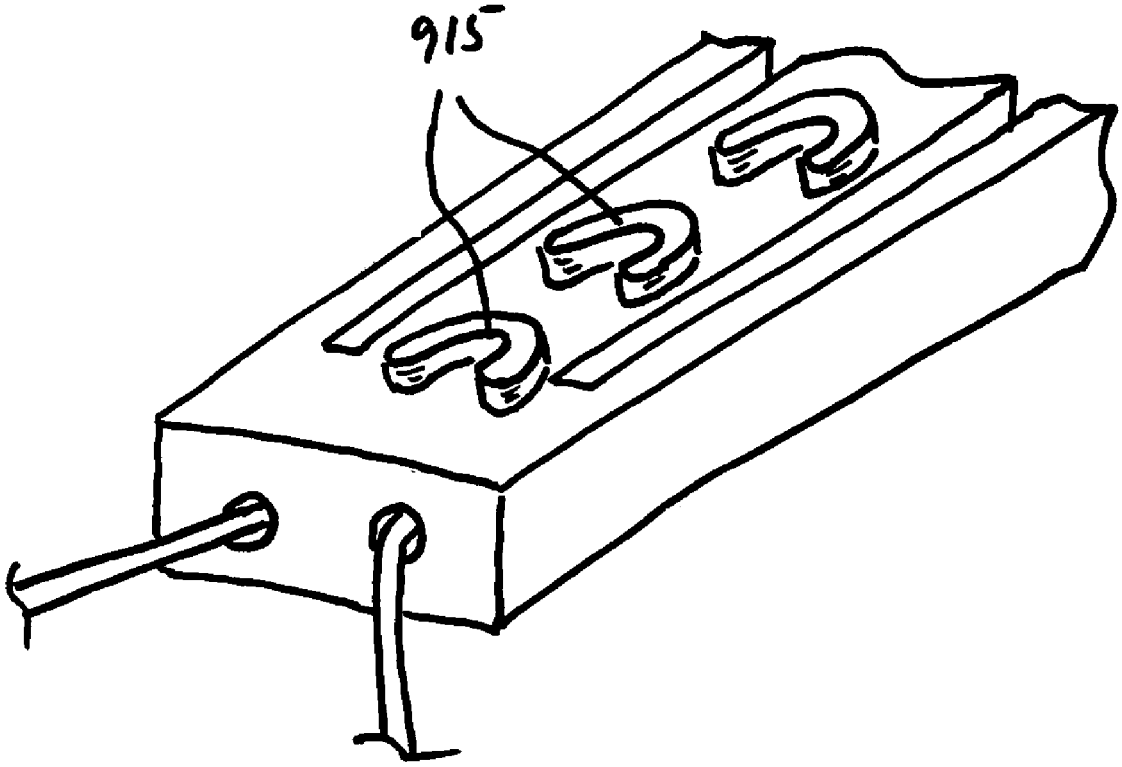
FIG. 30 is an illustration of alternate embodiment of an endpin holder that is provided with bossed structure as an alternative to the pockets provided in the other embodiments.

FIG. 25 is an illustration of the endpin restraint 710 in its fully extended configuration, i.e. the endpin holder 712 being the furthest away from the musician's chair. The distal end of the tension member 713 with its stop 714 is pulled through the hole 717 from the proximal end 712*p* of the endpin holder to the distal end 712*d*. In an embodiment of the endpin restraint 710, the cross-sectional shapes and dimensions of the stop 714 and the hole 717 are configured such that the stop 714 will pass through the hole 717. FIG. 29 illustrates this example. Alternatively, the stop 714 could be larger than the hole 717.

As shown in FIG. 26, which is a side view of the endpin restraint 710 of FIG. 25, the distal end of the tension member 713 is slid into the locking slot 718 so that the stop 714 prevents the tension member 713 from being pulled back through the hole 717. Generally, the stop 714 is configured to have a size and dimension that is larger than the locking slot 718 so that the stop 714 does not pass through or disengage from the locking slot 718. Alternatively, in the configuration of FIG. 25 where the endpin holder 712 is at its furthest distance from the musician's chair, the locking slot 718 is not a necessary feature. The stop 714 just has to be larger than the hole 717 so that the stop 714 cannot be pulled through the hole 717. Of course, for assembly consideration of the endpin restraint, such embodiment will require that either the stop 714 be affixed to the distal end of the flexible tension member 713 after the tension member 713 has been threaded through the hole 717 or the rings 719 on the proximal ends of the tension member 713 are just loops formed by the flexible tension member, in which case the tension member 713 can be threaded through the hole 717 by inserting the looped ends from the distal end of the hole 717.

FIG. 27 is an illustration of the endpin restraint 710 in a second configuration that positions the endpin holder 712 closer to the musician's chair. This is accomplished by wrapping the tension member 713 one or more times around the circumference of the endpin holder 712 (shown by the arrows A) in the slot 711 and then locking the endpin restraint by sliding the distal end of the tension member 713 into the locking slot 718. As before, the stop 714 at the distal end of the tension member 713 interferes with the locking slot 718 and locks the endpin restraint 710 in this configuration. Thus, the combination of the circumferential slot 711 and the locking slot 718 enable the tension member 713 to be secured to the endpin holder 712 and also provide ways to adjust the length of the tension member 713. The side view of this configuration is shown in FIG. 28.

In another embodiment, one or more locking slots 718 may be provided around the periphery of the upper portion 712*b* of the endpin holder 712. The actual placement of the one or more locking slots 718 around the periphery of the endpin holder 712 is determined by the desired incremental distance the endpin holder 712 needs to be moved closer to the musician. Similar to the example shown in FIG. 33, generally, the endpin holder 712 would need to be moved closer to the musician sufficient distance (about equal to the distance spanned by the row of the plurality of pockets 15) to provide additional range of anchoring points for the endpin.

Similar to the other embodiments described above, the flexible tension member 713 in this embodiment also can be a continuous loop rather than being open-ended as shown in FIGS. 25 and 27. In such case, the proximal end of the loop of tension member 713 is simply wrapped around the two front legs of the musician's chair similar to the embodiment shown in FIGS. 4 and 5.

As discussed above, the pockets 15 do not need to be in a linear pattern. Furthermore, the pockets 15 may be provided in any geometric shape and size as long as they are large enough to receive the free end of the endpin and is sufficiently deep to prevent the endpin from popping or sliding out when not desired. They do not even have to be of the same size in a given endpin holder. Alternatively, the pockets 15 need not even be pockets, i.e. concave structures. The pockets 15 may be substituted by protruding boss(es) or shoulder(s) 915 as shown in FIG. 29.

Figure 33:
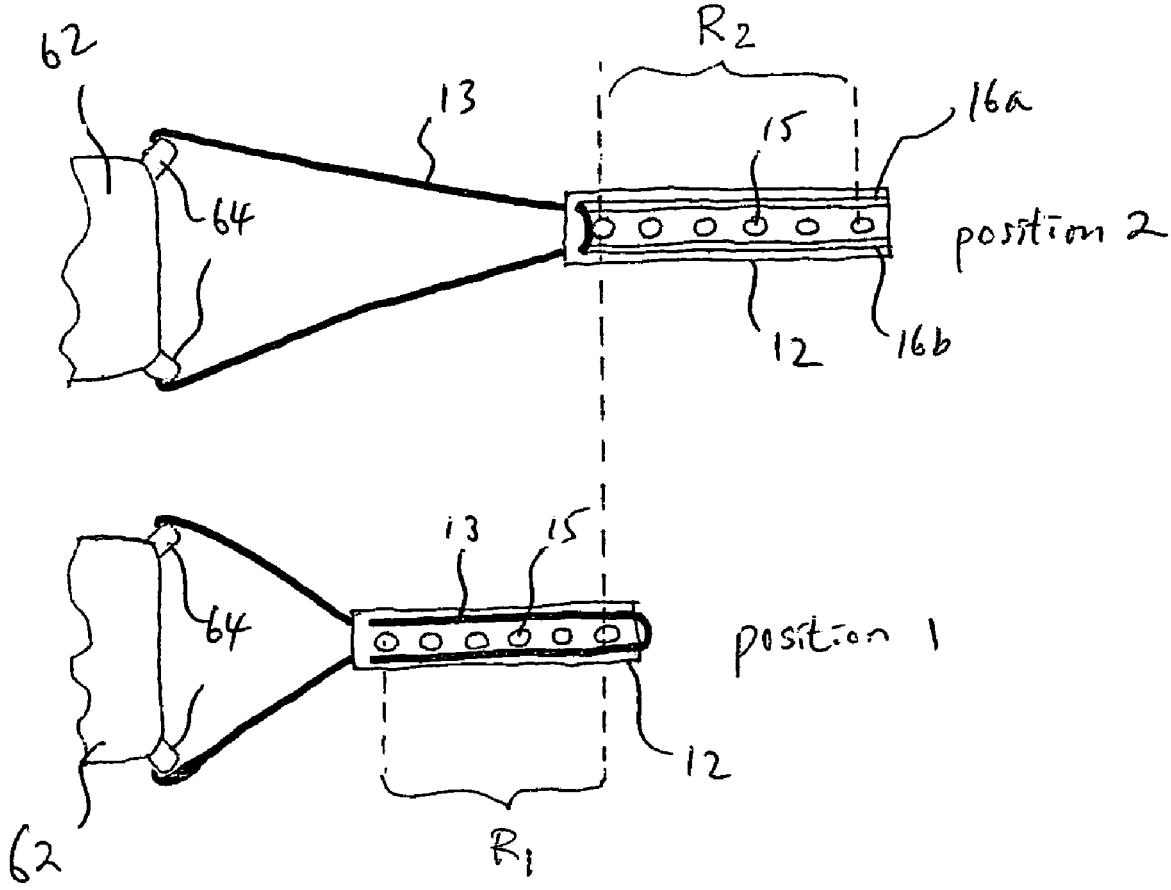
FIG. 33 is a top plan view of two endpin restraints shown side-by-side to illustrate the adjustability of the endpin restraint of the present invention.

Referring to FIG. 33, the advantage of the adjustability provided by the endpin restraint of present invention is not found in the conventional endpin restraint devices. FIG. 33 shows the endpin restraint 10 of FIGS. 2 and 3 in a side-by-side comparison. In Position 1, the flexible tension member 13 is threaded through the full length of the longitudinal slots 16*a*, 16*b* thus positioning the endpin holder 12 at its closest position to the musician's chair 62. This Position 1 provides a first range R1 of anchoring positions for an endpin (not shown) of a cello, for example, represented by the plurality of pockets 15. In Position 2, the flexible tension member 13 is threaded through the slots 16*a*, 16*b* only at the proximal end 12*p* and the endpin holder 12 is further away from the chair 62 providing the musician with an extended range R2 of anchoring positions for the endpin.

In an alternative embodiment of the endpin holder according to the present invention, the endpin holder may be provided with structures (e.g. pins or hook-like projections) protruding from the surface of the endpin holder rather than the slots or groove-like structures described herein in reference to the figures. The flexible tension member can be wrapped around the one or more of these protruding structures to adjust the length of the tension member.

While the foregoing invention has been described with reference to the above embodiments, various modifications and changes can be made without departing from the spirit of the invention. Accordingly, all such modifications and changes are considered to be within the scope of the appended claims.

What is claimed is:

1. An endpin restraint for a floor-resting musical instrument comprising:

an endpin holder for positioning at a distance from a chair upon which a musician is seated to play the musical instrument, the endpin holder having a proximal end, a distal end and an upper surface provided with a plurality of endpin receiving structures;

a pair of longitudinally extending slots provided on the endpin holder;

a pair of holes provided on the endpin holder, each of the holes extending from the proximal end of the endpin holder to respective slots and in communication with the respective slots; and a flexible tension member, having a proximal end and a distal end, for connecting the endpin holder to the chair, a portion of the flexible tension member being threaded through the pair of holes and the longitudinally extending slots, wherein the distance between the endpin holder and the chair is adjusted by changing length of said portion of the flexible tension member threaded through the pair of holes and the longitudinally extending slots.

2. An endpin restraint according to claim 1, wherein the chair has at least two front legs and the flexible tension member is a continuous loop wherein the proximal end of the tension member is connected to the chair by being looped around the two front legs of the chair during use.

3. An endpin restraint according to claim 1, wherein the chair has at least two back legs and the flexible tension member is a continuous loop wherein the proximal end of the tension member is connected to the chair by being looped around the two back legs of the chair during use.

4. An endpin restraint according to claim 1, wherein the flexible tension member is open-ended at the proximal end having two terminating ends and a ring provided at each of the terminating ends of the flexible tension member for receiving a leg of the chair during use.

5. An endpin restraint according to claim 1, wherein the endpin receiving structures are arranged linearly along the length of the endpin holder.

6. An endpin restraint according to claim 1, wherein the endpin receiving structures are pockets.

7. An endpin restraint according to claim 1, wherein the endpin receiving structures are structures protruding from the upper surface of the endpin holder.

8. An endpin restraint according to claim 1, wherein said length of the portion of the flexible tension member threaded through the pair of holes and the longitudinally extending slots is adjustable between two configurations.

9. An endpin restraint according to claim 1, further comprising one or more connecting slots between the pair of longitudinally extending slots for providing additional paths for threading the flexible tension member therethrough, wherein said length of the portion of the flexible tension member threaded through the pair of holes and the longitudinally extending slots is adjustable to more than two configurations.

10. An endpin restraint according to claim 1, wherein the pair of longitudinal slots are provided on the upper surface of the endpin holder.

11. An endpin restraint according to claim 1, wherein the flexible tension member is a continuous loop.

12. An endpin restraint according to claim 1, wherein the flexible tension member is an open-ended loop having two ends, each of the two ends being threaded through each of the pair of holes and through the respective longitudinally extending slots, wherein each of the two ends being provided with a stop.

* * * * *